United States Patent [19]

Carter

[11] Patent Number: 4,786,938

[45] Date of Patent: Nov. 22, 1988

[54] PROCESS UNIT FOR AN IMAGING APPARATUS

[75] Inventor: Robert A. Carter, Stevenage, England

[73] Assignee: Xerox Corporation, Stamford, Conn.

[21] Appl. No.: 131,162

[22] Filed: Dec. 10, 1987

[30] Foreign Application Priority Data

Dec. 15, 1986 [GB] United Kingdom ..... 8629941

[51] Int. Cl.[4] ..... G03G 15/00

[52] U.S. Cl. ..... 355/3 R; 355/3 SH

[58] Field of Search ..... 355/3 R, 3 TR, 3 DR, 355/3 CH, 3 SH, 14 SH; 206/409

[56] References Cited

U.S. PATENT DOCUMENTS

| | | | |
|---|---|---|---|
| 3,109,355 | 11/1963 | Ritzerfeld et al. | 95/1.7 |
| 3,985,436 | 10/1976 | Tanaka et al. | 355/8 |
| 4,190,348 | 2/1980 | Friday | 355/3 TR |
| 4,291,802 | 9/1981 | Buelens | 206/409 |
| 4,392,738 | 7/1983 | Fujino et al. | 355/3 TR |
| 4,460,267 | 7/1984 | Ogawa | 355/3 DD |
| 4,462,677 | 7/1984 | Onoda | 355/3 R |
| 4,470,689 | 9/1984 | Nomura et al. | 355/3 R |
| 4,531,823 | 6/1985 | Deguchi et al. | 355/3 R |
| 4,540,268 | 9/1985 | Toyono et al. | 355/3 DR |
| 4,566,777 | 1/1986 | Honda et al. | 355/3 R |
| 4,583,832 | 4/1986 | Kasamura et al. | 355/3 DD |
| 4,588,280 | 5/1986 | Ogawa et al. | 355/3 R |
| 4,598,993 | 7/1986 | Mizutani et al. | 355/3 DR |
| 4,605,299 | 8/1986 | Mochimaru | 355/3 DR |
| 4,607,941 | 8/1986 | Honda | 355/3 DR |
| 4,609,276 | 9/1986 | Mitzutani | 355/3 R |
| 4,634,264 | 1/1987 | Takahashi | 355/3 BE |
| 4,673,956 | 6/1987 | Kobayashi | 355/3 DR |
| 4,707,748 | 11/1987 | Ohtsuka et al. | 355/3 DR |
| 4,708,455 | 11/1987 | Kubota et al. | 355/3 DR |
| 4,737,817 | 4/1988 | Kando et al. | 355/3 DR |

FOREIGN PATENT DOCUMENTS

| | | | |
|---|---|---|---|
| 54-114248 | 9/1979 | Japan . | |
| 56-121060 | 9/1981 | Japan . | |
| 61-97663 | 5/1986 | Japan | 355/3 R |

*Primary Examiner*—R. L. Moses

[57] ABSTRACT

A process unit which can be removably mounted in a main assembly of an electrostatographic copying machine has a housing enclosing an imaging member and, optionally, other processing means such as a development device, a cleaner, and a charge corotron. The transfer corotron, for transferring a toner image from the photoreceptor to a copy sheet is preferably incorporated in the cassette housing. An aperture is present in the housing adjacent corotron so that a copy sheet can enter the unit to have an image transferred thereto from the photoreceptor. A simple resilient cover flap is provided over the aperture which protects the imaging member from contamination, physical damage, and light exposure when the cassette is removed from the main assembly of the copier. The flap is readily displaced as an entering copy sheet bears against it, thus enabling a copy sheet to pass. As the trail edge of the copy sheet leaves the aperture the resilient flap reverts to its former position in which it closes the aperture until the arrival of a subsequent copy sheet. Instead of a resilient flap the cover may be formed by a brush.

20 Claims, 4 Drawing Sheets

PROCESS UNIT FOR AN IMAGING APPARATUS

CROSS REFERENCE TO RELATED APPLICATIONS

Reference is made to the following copending applications filed concurrently herewith: application Ser. No. 131,163 entitled "Process Unit Incorporating A Charging Device" in the name of Alan C. R. Howard et al. application Ser. No. 131,075 entitled "Process Unit For An Imaging Apparatus" in the name of Alan C. R. Howard et al.; application Ser. No. 131,074 entitled "Process Unit For An Imaging Apparatus" in the name of Alan C. R. Howard et al; application Ser. No. 130,920 entitled "Electrostatographic Reproducing Machine and Process Unit Therefore" in the name of David M. Newbury; application Ser. No. 131,073 entitled "Fiber Traps in Copiers" in the name of Philip R. Thompson. Reference is also made to copending application Ser. No. 038,093 entitled "Process Unit For An Imaging Apparatus" filed Apr. 14, 1987 in the name of Robert A. Carter.

BACKGROUND OF THE INVENTION

This invention relates to a process unit adapted to be removably mounted in a main assembly of an electrostatographic reproducing machine, the unit comprising a housing and an imaging member inside the housing. The invention further relates to an electrostatographic reproducing machine employing such a process unit.

In the art of electrostatographic reproduction there is a trend to incorporate the imaging member, i.e. the photoreceptor, together with other process means such as a charge corotron, a development device, and a cleaning device in a removable process unit or so-called cassette as disclosed for example, in U.S. Pat. No. 3,985,436 to Tanaka et al. The use of such a cassette enables the easy replacement of those parts of the copying machine which are most likely to deteriorate with use, especially the photoreceptor, but also the development and cleaning systems as well as the charge corotron wire. A further advantage of containing the major process elements within a cassette is that interchangeable cassettes may be used in a given copying machine to provide different development characteristics or different coloured development.

A problem with the cassette disclosed in U.S. Pat. No. 3,985,436 is that when it is removed from the main assembly of the copying machine the part of the imaging member where image transfer occurs in the copying machine is unprotected and is therefore susceptible to damage or contamination, and also to light exposure which can result in premature deterioration of the photosensitive material on the imaging member. Needless to say, these adverse affects are likely to impair the quality of image formation.

PRIOR ART

With a view to overcoming this problem it has been proposed to provide a cassette with a retractable cover for shielding and protecting the imaging member. For example, U.S. Pat. No. 4,470,689 to Nomura et al discloses a cassette with a movable cover mounted below the cassette housing, but integral therewith. An actuating device is included whereby the cover is automatically rotated to a closed position to shield the imaging member when the cassette is removed from the main assembly of the copying machine, and when the cassete is inserted into the main assembly the cover is automatically rotated to an open position to expose the imaging member at the area where image transfer occurs. The arrangement is such that the cover remains open during normal operation of the machine.

A similar protection cover for a process unit is described in U.S. Pat. No. 4,462,677 to Onoda wherein the cover is moved from a protective position to an open position in response to another operation of the main apparatus such as for example opening the machine to remove a paper jam. These arrangements suffer the drawback that they employ relatively elaborate mounting and actuating mechanisms for the covers which are likely to result in increased cost and diminished reliability.

U.S. Pat. No. 4,609,276 to Mitzutani illustrates similar process units for use in image formation apparatus. FIGS. 10A through 10G illustrate several alternative arrangements for a process unit to contain various process means. FIG. 10G illustrates such a unit which in addition to including an imaging drum, charging device and developer also includes a transfer discharger and a protective cover. In this regard attention is also directed to the discussion in Onoda of FIGS. 13A to 13F at column 8, lines 35 to 64 and Nomura et al of FIGS. 15A to 15F at column 8 lines 15 to 45 concerning the inclusion of a transfer discharger in the process unit.

SUMMARY OF THE INVENTION

According to a first aspect of the present invention there is provided a process unit adapted to be removably mounted in a main assembly of an electrostatographic reproducing machine, the process unit comprising a housing, an imaging member inside the housing, the housing having an aperture through which a copy sheet may enter the process unit for transferring an image from the imaging member to the copy sheet when the process unit is installed in the main assembly, and means providing an opaque cover which is arranged normally to adopt a closed position covering the aperture, the cover means being adapted to be displaced from the closed position by the action of an entering copy sheet bearing against it thereby enabling the copy sheet to enter the process unit.

With this process unit it is intended that the copy sheet actually enters the unit itself through an aperture provided in the unit housing. Image transfer from the imaging member to the copy sheet can thus be effected within the interior of the process unit. This is advantageous because the aperture need only be relatively narrow to enable a copy sheet to enter, thus dispensing with the need for elaborate cover mechanisms of the kind found in the prior art. By contrast, the process unit of the present invention uses only a very simple cover member, for example in the form of a resilient flap or a brush, which is readily displaced by the action of an entering copy sheet bearing against it.

Suitably the transfer charging device is included as part of the process unit and, more especially, as part of the unit housing. In this case the transfer charging device itself shields and protects the imaging member from light exposure, damage, and contamination when the unit is removed from the main assembly of the copying machine.

An additional advantage of having the transfer charging device integral with the unit housing is that the transfer charging device will be replaced automatically whenever the process unit is exchanged for a fresh one without having to change the transfer charging device separately.

According to a further aspect of the invention there is provided an electrostatographic copying machine employing a process unit in accordance with the first aspect of the invention.

In one embodiment, a guide member formed integrally with the housing is also included for guiding copy sheets to the aperture. This guide member may comprise an extended portion of the transfer charging device.

BRIEF DESCRIPTION OF THE DRAWINGS

An embodiment of the invention will now be described, by way of example, with reference to the accompanying drawings in which.

DETAILED DESCRIPTION OF THE INVENTION

Figure 1:
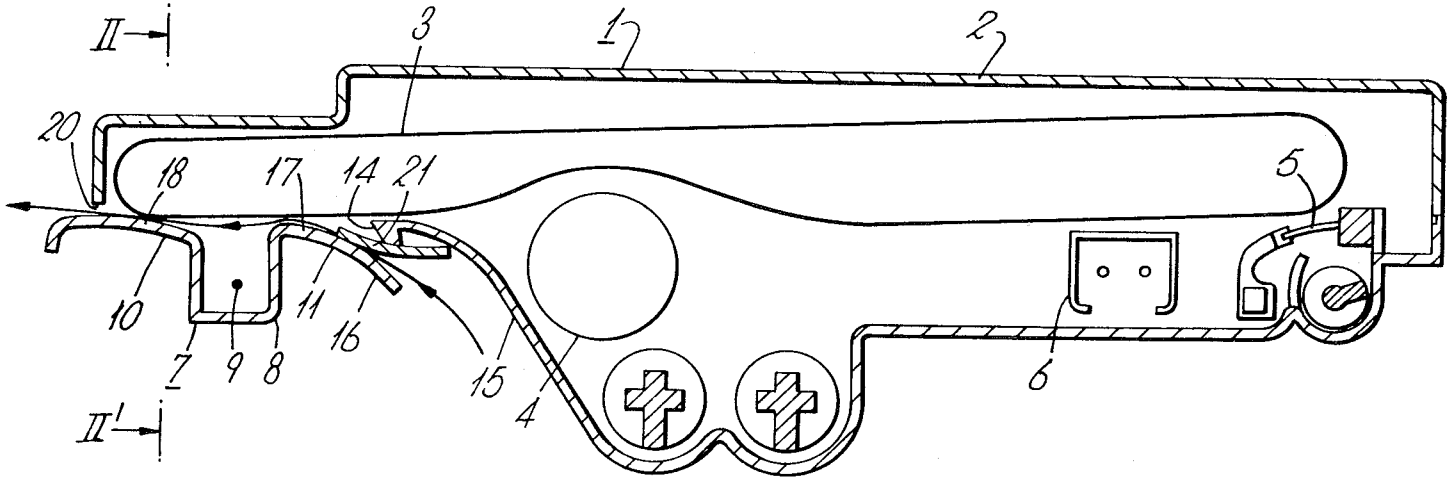
FIG. 1 is a schematic cross section of a process unit having an integral transfer corotron in accordance with the invention.

It is noted that for the sake of clarity the Figures are not drawn to scale. In particular, in FIG. 2, the dimensions in the vertical direction have been exaggerated. The same features are denoted by the same reference numerals in each of the Figures.

The process unit or cassette 1 shown in FIG. 1 is designed to be removably mounted in the main assembly of a xerographic copier as described, for example, in the aforementioned U.S. Patents and also in our copending U.S. patent application Ser. No. 038,093 filed Apr. 14, 1987, entitled Process Unit For An Imaging Apparatus in the name of Robert A. Carter commonly assigned to the assignee of the present invention.

The cassette 1 comprises a housing 2 made for example, primarily of polystyrene which encloses an imaging member in the form of a belt photoreceptor 3 in addition to various process means, in particular a development device 4, a cleaner 5, and a charge corotron 6. The belt photoreceptor is an endless flexible belt 3 having a photosensitive surface. In the arrangement shown, when the cassette 1 is removed from the main assembly 100 of the copier the belt is only loosely retained in the cassette, but when the cassette is inserted into the main assembly of the copying machine the photoreceptor belt is supported in an operative position by a member (not shown) forming part of the main assembly. A cassette having this kind of loosely retained photoreceptor arrangement forms the subect of our above referenced copending U.S. patent application Ser. No. 038,093 to which reference is invited for further details.

Returning to the present FIG. 1, a transfer charging device 7 is included in the cassette housing in the vicinity of the photoreceptor belt at the area where a toner image is to be transferred from the belt to a copy sheet. The technique of actually transferring a toner image is well known to those skilled in the art and no further details need be given here. The transfer charging device 7 is in the form of a corotron having an outer shield 8 which, as is conventional, is substantially U-shaped and made for example of stainless steel. A corona wire 9 extends the full length of the shield 8 and is spaced apart from the walls thereof in the usual manner.

At its upper end the shield has extended portions 10 and 11 on its left- and right-hand sides respectively, as viewed in the drawing. These portions 10 and 11 define the path which a copy sheet follows as it passes through the cassette for the purposes of having a toner image transferred thereto, as described in more detail below.

The manner in which the transfer corotron 7 is fixed to the cassette housing 2 will now be described.

Figure 2:
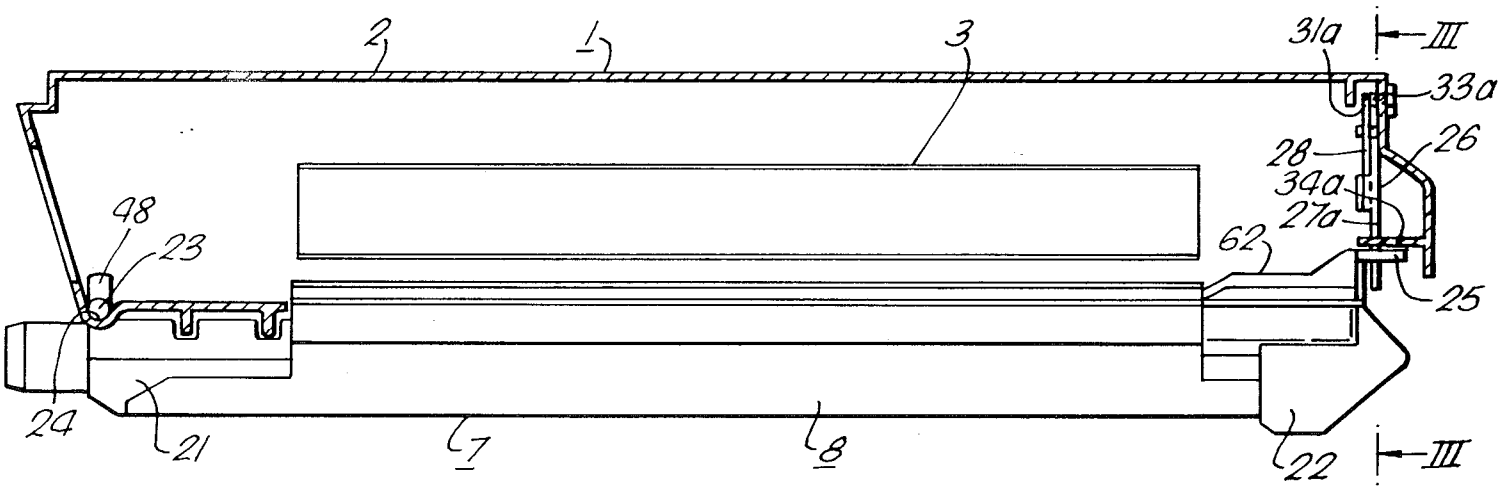
FIG. 2 is a schematic cross section of the process unit taken on the line II—II in FIG. 1.
Figure 3:
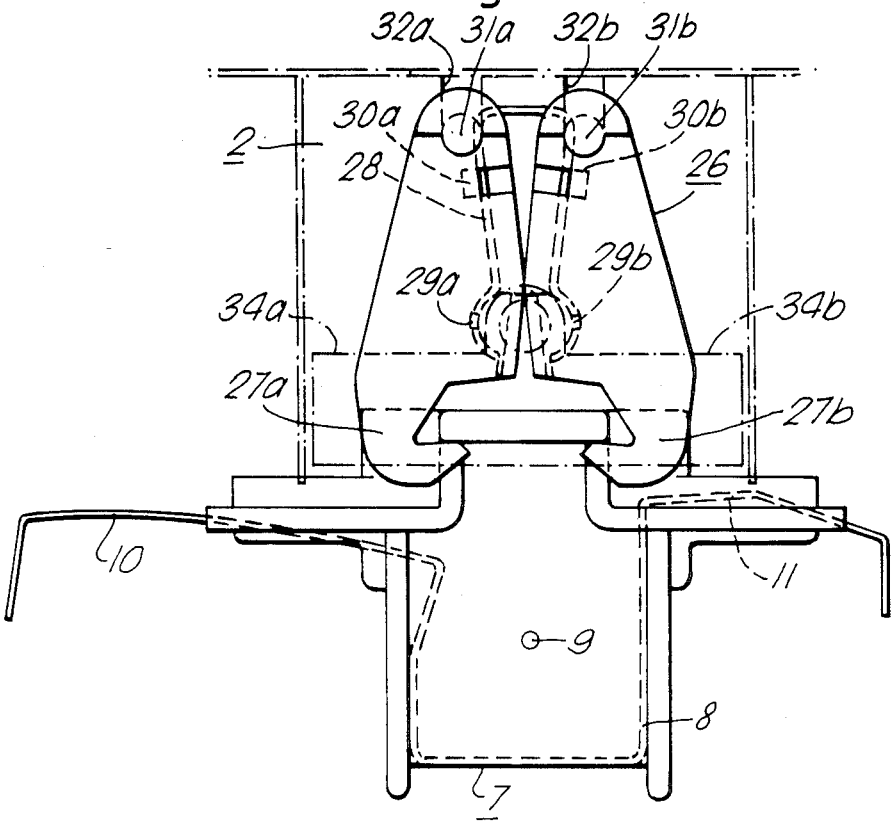
FIG. 3 is a cross section showing detail of a latch mechanism for retaining the corotron in the process unit taken on the line III—III in FIG. 2.

As shown in FIG. 2, the corotron 7 has end caps 21, 22 fastened to opposite ends of shield 8. The end caps 21, 22 are made of a plastics material. End cap 21 has a projecting pin extending from its side faces both into and out of the plane of FIG. 2. The pin 23 is accommodated in sockets 24 formed integrally in the cassette housing 2. Two such sockets 24 are provied, one on each side of the end cap 21. At the opposite end of the corotron 7, the other end cap 22 has a projecting tab 25 which engages in a latch mechanism 26 as shown more clearly in FIG. 3. The tab 25 is held by two jaws **27*a*, 27*b* of the latch which are biased together by an inverted keyhole-shaped spring 28. The spring 28 is held in place by pairs of tabs 29*a*, 29*b*; 30*a*, 30*b* formed integrally on the inward face of the jaws 27*a*, 27*b*. The upper portion of each jaw 27*a*, 27*b* is provided with a protruding post 31*a*, 31*b* with an enlarged head 33*a*, 33*b* extending from the outward face. The posts 31*a*, 31*b* are accommodated in slots 32*a*, 32*b* respectively in the cassette housing, thus providing a pivotal mounting for the jaws. The enlarged heads 33*a*, 33*b* which act to retain the latch in its own plane are present on the outside of the cassette housing as can be seen most clearly in FIG. 2. The latch is also held in place by two bail bars 34*a*, 34*b* formed on a recessed portion of the internal wall of the cassette housing 2. The bail bars 34*a*, 34*b* are both joined to the cassette housing at each of their two ends, thereby providing a slot between the bars and the cassette housing through which the jaws 27*a*, 27*b* are threaded, thereby limiting their pivotal movement as well as holding them in their own plane (see FIG. 3). When the cassette is outside the main assembly of the copying machine the jaws 27*a*, 27*b* of the latch 26 are closed to support the corotron as shown in FIG. 3. However, the latch is adapted to be opened automatically to release the corotron when the cassette is inserted into the main assembly of a copying machine, which enables the corotron to be located accurately relative to the photoreceptor when it is in the operative position in the machine and also enables the corotron to be hinged open about pivot pin 23 to allow for clearance of jammed copy sheets. These features are the subject of our above referenced copending patent applications Ser. Nos. 131,163 and 131,074 to which reference is inited for further details. It is noted, however, that it is not necessary for the transfer corotron 7 to have a hinge and latch mounting as described above. Instead the transfer corotron 7 may for example simply be fixed rigidly at each of its two ends to the side walls of the cassette housing 2**.

As can be seen from the Figures, the outside of the corotron shield 8 forms part of the external wall of the housing 2.

An aperture 14 is present between the right-hand extension 11 of corotron shield 8 and the main part of the cassette housing to enable a copy sheet to enter the process unit for the purpose of transferring an image thereto from the photoreceptor belt 3 in the vicinity of the transfer corotron when the cassette is inserted into the main assembly of the copying machine. The aperture 14 is in the form of a slot extending substantially the full width of the cassette but being relatively narrow, for example 2 mm wide. An opaque cover 21 in the form of a resilient flap is located over the aperture 14. The cover flap 21, which may suitably be made of a polyester or polycarbonate material is secured by adhesive to the underside of the main part of the housing 2 at the downstream side relative to the direction of travel of a copy sheet entering the cassette. The downstream side of the flap, which is free, extends a short way into the process unit and by virtue of its inherent resilience bears lightly against the upper side of the ramp portion 17 of the corotron shield extension 11.

The path which a copy sheet follows as it passes through the cassette for image transfer purposes is denoted by an arrow in FIG. 1. The external wall portion 15 of the main part of the cassette housing is shaped so as to deflect and guide the approaching copy sheets towards the aperture 14. Furthermore, the extreme right-hand side of the extended portion 11 of corotron shield 8 has a steeply downturned lip 16 adjoining the less steeply inclined ramp portion 17. The downturned lip 16 and ramp portion 17 thus also act to guide approaching copy sheets towards the aperture 14.

As an approaching copy sheet arrives and bears against the cover flap 21 it causes the flap to yield under its own flexibility and so the cover is raised slightly at the area of the ramp portion 17 permitting the copy sheet to pass by and enter the cassette through the aperture 14.

As the copy sheet enters the cassette it follows the path defined between the photoreceptor belt 3 and the ramp portion 17 of the corotron shield extension 11. The copy sheet then passes over the main part (i.e. the shield 8 and the wire 9) of the transfer corotron 7 where the toner image is transferred from the photoreceptor belt to the copy sheet itself in known manner. From there the copy sheet traverses the slightly upwardly inclined ramp 18 forming part of the shield extension 10 on the left hand side of the corotron 7, and thence to aperture 20 in the cassette housing where the copy sheets exits the cassette for further processing, in particular for the toner image to be fixed permanently to the copy sheet using techniques well known to persons skilled in the art. When the trail edge of the copy sheet leaves the aperture 14 the cover flap 21 reverts to its initial rest position bearing against the ramp portion 17 of cororon shield extension 11 by virtue of its own resilience, thereby re-closing the aperture 14 until the next copy sheet arrives.

Figure 4:
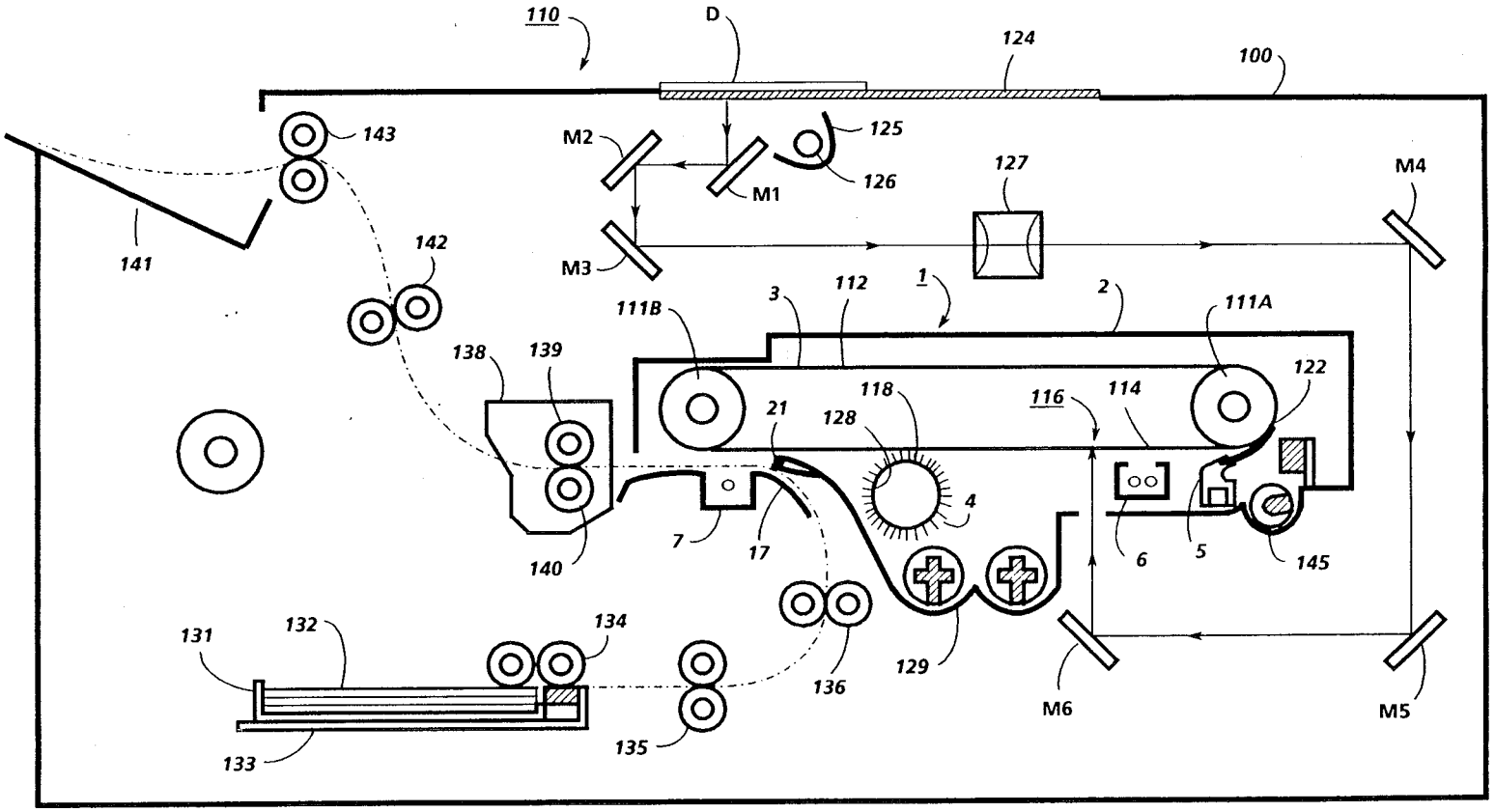
FIG. 4 is a schematic view in cross section of a reproducing machine having a process cassette according to the present invention.

Referring now to FIG. 4, there is shown schematically a xerographic printing machine 110 having the removable process unit 1 of the present invention in its operational position in the main assembly 100. The machine includes an endless flexible photoreceptor belt 1 mounted for rotation in the clockwise direction as shown about support rollers 111*a* and 111*b* to carry the photosensitive imaging surface 112 of the belt 3 sequentially through a series of xerographic processing stations, namely a charging station 114, an imaging station 116, a development station 118, a transfer station 120, and a cleaning station 122.

The charging station 114 comprises a corotron 6 which deposits a uniform electrostatic charge on the photoreceptor belt 3. The photoreceptor belt 3, the charge corotron 6, the developer device 4, the transfer corotron 7, and the blade cleaner 5 may all be incorporated in a process cassette 1 adapted to be removably mounted in the main assembly 100 of the xerographic copier as described in aforementioned copending application Ser. No. 038,093.

An original document D to be reproduced is positioned on a platen 124 and is illuminated in known manner a narrow strip at a time by a light source comprising a tungsten halogen lamp 126. Light from the lamp is concentrated by an elliptical reflector 125 to cast a narrow strip of light on to the side of the original document D facing the platen 124. Document D thus exposed is imaged on to the photoreceptor 1 via a system of mirrors M1 to M6 and a focusing lens 127. The optical image selectively discharges the photoreceptor in image configuration, whereby an electrostatic latent image of the original document is laid down on the belt surface at imaging station 116. In order to copy the whole original document the lamp 126, the reflector 125, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 127 along its optical axis closer to the original document i.e. closer to mirrors M2 and M3, for magnification greater than unity, and away from the mirrors M2 and M3 for reduction, i.e. magnification less than unity. When the lens 127 is moved, the length of the optical path between the lens and the photoreceptor, i.e. the image distance, is also varied by moving mirrors M4 and M5 in unison to ensure that the image is properly focuse on the photoreceptor 1. For this purpose mirrors M4 and M5 are suitably mounted on a further carriage (not shown).

At the development station 118, a magnetic brush developer device with a developer roll 128 develops the electrostatic latent image into visible form. Here, toner is dispensed from a hopper (not shown) into developer housing 129 which contains a two-component developer mixture comprising a magnetically attractable carrier and the toner, which is deposited on the charged area of belt 1 by a developer roll 128.

The developed image is transferred at transfer station 120 from the belt to a sheet of copy paper according to the practice of the present invention. The copy paper is delivered into contact with the belt in synchronous relation to the image from a paper supply system 131 in which a stack of paper copy sheets 132 is stored on a tray 133. The top sheet of the stack in the tray is brought, as required, into feeding engagement with a top sheet separator/feeder 134. Sheet feeder 134 feeds the top copy sheet of the stack towards the photoreceptor around a 180° path via two sets of nip roll pairs 135 and 136. The path followed by the copy sheets through the aperture in the cassette is denoted by a broken line. At the transfer station 120 transfer corotron 7 provides the electric field to assist in the transfer of the toner particles thereto.

The copy sheet bearing the developed image is then stripped from the belt 1 and subsequently conveyed to a fusing station 138 which comprises a heated roll fuser 139 to which release oil may be applied in known manner. The image is fixed to the copy sheet by the heat and pressure in the nip between the two rolls 139 and 140 of the fuser. The final copy is fed by the fuser rolls into catch tray 141 via two further nip roll pairs 142 and 143.

After transfer of the developed image from the belt some toner particles usually remain on the surface of the belt, and these are removed at the cleaning station 122 by a cleaner blade 5 which scrapes residual toner from the belt. The toner particles thus removed fall into a receptacle 145 below. Also, any electrostatic charges remaining on the belt are discharged by exposure to an erase lamp 146 which provides an even distribution of light across the photoreceptor surface. The photoreceptor is then ready to be charged again the the charging corotron 6 as the first step in the next copy cycle.

The patents and applications referred to herein are hereby specifically and totally incorporated herein by reference.

From the foregoing it will be evident that various modifications may be made within the scope of the present invention. For example, instead of a flexible flap the cover for the aperture in the cassette housing may be formed by a brush. Also, instead of a flexible belt the imaging member may comprise a photoreceptor drum as commonly used in xerographic machines. Moreover, apart from the transfer cororon, the cassette may enclose additional or alternative processing means to those described above. In addition, while the invention has been illustrated with respect to copying apparatus it will be understood that it may be used in printer apparatus where a light beam such as a laser beam may be used to selectively discharge portions of the photoconductor. All such modifications and embodiments as may readily occur to the artisan are intended to be within the scope of the appended claim.

I claim:

1. A process unit adapted to be removably mounted in a main assembly of an electrostatographic copying machine, the process unit comprising:

a housing, an imaging member inside the housing, the housing having an aperture through which a copy sheet may enter the process unit for transferring an image from the imaging member to the copy sheet when the process unit is installed in the main assembly, and means providiing an opaque cover which is arranged normally to adopt a closed position covering the aperture, the cover means being adapted to be displaced from the closed position by the action of an entering copy sheet bearing against it thereby enabling the copy sheet to enter the process unit.

2. A process unit as claimed in claim 1, wherein the cover means is fastened to the housing at its upstream side relative to the direction of travel of the copy sheet entering the process unit, and is free at its downstream side.

3. A process unit as claimed in claim 1 wherein the opaque cover means comprises a resilient flap.

4. A process unit as claimed in claim 3, wherein the resilient flap comprises polyester or polycarbonate.

5. A process unit as claimed in claim 1 wherein the opaque cover means comprises a brush.

6. A process unit as claimed in claim 1 further comprising a guide member for guiding a copy sheet to the aperture in the housing, the guide member being formed integrally with said housing.

7. A process unit as claimed in claim 6 further comprising a charging device for transferring an image from the imaging member to the copy sheet, wherein the guide member is formed integrally with said charging device.

8. A process unit as claimed in claim 7, wherein the charging device forms part of the housing, and the aperture is present immediately adjacent the charging device.

9. A process unit as claimed in claim 7 wherein the cover means in its closed position bears against the guide member.

10. A process unit a claimed in claim 1 further comprising a charging device for transferring an image from the imaging member to the copy sheet and wherein the chargiing device forms part of the housing, and the aperture is present immediately adjacent the charging device.

11. An electrostatographic printing machine comprising a main assembly, and a process unit adapted to be removably mounted in said main assembly, said process unit comprising:

a housing, an imaging member inside the housing, the housing having an aperture through which a copy sheet may enter the process unit for transferring an image from the imaging member to the copy sheet when the process unit is installed in the main assembly, and means providing an opaque cover which is arranged normally to adopt a closed position covering the aperture, the cover means being adapted to be displaced from the closed position by the action of an entering copy sheet bearing against it thereby enabling the copy sheet to enter the process unit.

12. A printing machine as claimed in claim 11, wherein the cover means is fastened to the housing as its upstream side relative to the direction of travel of the copy sheet entering the process unit, and is free at its downstream side.

13. A printing machine as claimed in claim 11, wherein the opaque cover means comprises a resilient flap.

14. A printing machine as claimed in claim 13, wherein the resilient flap comprises polyester or polycarbonate.

15. A printing machine as claimed in claim 11 wherein the opaque cover means comprises a brush.

16. A printing machine as claimed in claim 11 further comprising a guide member for guiding a copy sheet to the aperture in the housing, the guide member being formed integrally with said housing.

17. A printing machine as claimed in claim 16 further comprising a charging device for transferring an image from the imaging member to the copy sheet, wherein the guide member is formed integrally with said charging device.

18. A printing machine as claimed in claim 17, wherein the charging device forms part of the housing, and the aperture is present immediately adjacent the charging device.

19. A printing machine as claimed in claim 17 wherein the cover means in its closed position bears against the guide member.

20. A printing machine as claimed in claim 11 further comprising a charging device for transferring an image from the imaging member to the copy sheet and wherein the charging device forms part of the housing, and the aperture is present immediately adjacent the charging device.

* * * * *